US005926988A

United States Patent [19]

Casull

[11] Patent Number: 5,926,988

[45] Date of Patent: Jul. 27, 1999

[54] MECHANICAL TIGHT CARTRIDGE CASING RELEASE FOR A RIFLE BOLT

[76] Inventor: Richard J. Casull, P.O. Box 243, Freedom, Wyo. 83120

[21] Appl. No.: 09/009,967

[22] Filed: Jan. 21, 1998

[51] Int. Cl.[6] ..... F41A 3/34

[52] U.S. Cl. ..... 42/25; 42/16

[58] Field of Search ..... 42/25, 16; 89/1.42

[56] References Cited

U.S. PATENT DOCUMENTS

| | | | |
|---|---|---|---|
| 1,170,014 | 2/1916 | Stamm | 42/25 |
| 3,005,279 | 10/1961 | Brewer | 42/18 |
| 3,103,757 | 9/1963 | Brewer | 42/25 |
| 3,253,362 | 5/1966 | Gitchell | 42/16 |
| 3,477,162 | 11/1969 | Morse | 42/25 |
| 4,272,902 | 6/1981 | Waters | 42/25 |
| 5,700,967 | 12/1997 | Guhring | 89/1.42 |

*Primary Examiner*—Charles T. Jordan
*Assistant Examiner*—Meena Chelliah
*Attorney, Agent, or Firm*—M. Reid Russell

[57] ABSTRACT

A mechanical tight cartridge casing release of the invention is preferably for inclusion with a large cartridge rifle bolt and includes a pivot mounting of a rifle bolt arm or handle to the bolt whereby, after the arm or handle is moved to an unlocked position, an application of a force to the arm or handle end wil pivot that arm or handle relative to the bolt surface such that an arm or handle forward shoulder engages a surface of the rifle receiver producing a lever action and providing a mechanical advantage to the force applied by an operator or shooter that arm or handle to "break loose" the spent cartridge casing from the barrel chamber, with the bolt to then be moved rearwardly to where the casing is ejected. The relationship of the distance from the bolt handle end that is pulled by the operator or shooter to the arm or handle pivot and the distance from the pivot to the handle forward shoulder is selected to provide a desired mechanical advantage whereby a pulling force as is exerted through the arm or handle is increased to "break loose" the spent cartridge casing that will have expanded in the rifle chamber when the cartridge is fired.

8 Claims, 2 Drawing Sheets

MECHANICAL TIGHT CARTRIDGE CASING RELEASE FOR A RIFLE BOLT

BACKGROUND OF THE INVENTION

1. Field of the Invention

The present invention relates to bolts for large chamber rifles that need a mechanical advantage to break a cartridge casing free from a rifle chamber after cartridge firing, facilitating that casing being pulled out of the chamber by operation of the bolt.

2. Prior Art

Heretofore, even for large chamber rifles where some difficulty can be expected to break a cartridge casing free of the rifle chamber, only a solid handle connected to the rifle bolt to be manually operated by a shooter or operator has been provided. With the shooter or operators strength alone being utilized to pull a spent cartridge casing out from a rifle chamber after cartridge firing. In which firing sequence, the casing will expand into tight fitting engagement in and will often "stick" in the rifle chamber, requiring that a strong pulling force be applied thereto to pull it free from that chamber. A recent development in large chamber rifle cartridges of the present invention as embodied in a current U.S. Patent Application of the present invention for a "Cartridge and Method of Manufacturing a Cartridge for a Firearm," filed Jul. 16, 1996, sets out a cartridge with a casing that has a significantly larger circumference than do earlier conventional cartridges. For a rifle utilizing such cartridge, where a rifle bolt is fitted into the cartridge primer end rather than is fitted around it, it has been found that it is difficult for an operator or shooter to apply a sufficient pulling force through a solid handle of a rifle bolt to break a spent cartridge casing out from the chamber to eject it. To solve this problem, the present invention provides a bolt arm that is pivotally connected to extend outwardly from the bolt surface. In operation, the operator or shooter lifts the bolt handle along a receiver vertical slot from a locked attitude into alignment with a horizontal receiver slot, whereat, by pulling a handle end rearwardly, a handle forward shoulder is pivoted against the side of the receiver at the forward end of the horizontal slot. The handle pivot mounting provides a mechanical advantage to increase the pulling force as the operator applies thereto, breaking the spent cartridge casing from its sealing engagement in the rifle chamber. Thereafter, the casing can be easily pulled from the rifle chamber by the operator holding the handle end and pulling the bolt rearwardly along the horizontal slot to where the spent casing is ejected from the receiver.

SUMMARY OF THE INVENTION

It is a principal object of the present invention in a mechanical tight cartridge casing release for a rifle bolt to provide the rifle bolt having a pivot mounted arm or handle that extends therefrom projecting beyond the side of the rifle receiver that provides to an operator or shooter a lever action to aid in breaking loose a fired or spent cartridge casing free from its tight fitting engagement in the rifle chamber.

Another object of the present invention in a mechanical tight cartridge casing release for a rifle bolt is to provide an arrangement of a bolt handle pivot mounting where a force applied by the operator or shooter through the handle that is pivotally mounted to the bolt to provide a lever action to pull a spent cartridge casing free from the rifle chamber is multiplied by a mechanical advantage, facilitating breaking that casing free from the rifle chamber.

Still another object of the present invention in a mechanical tight cartridge casing release for a rifle bolt is to provide the bolt an arm or handle with an end for convenience, for gripping by an operator or shooter who first lifts the arm or handle upwardly along a vertical receiver slot to unlock the bolt from its firing attitude, with the bolt then pulled rearwardly to move a pivot mounted end of the arm or handle against a receiver surface to provide a lever action breaking the spent cartridge casing loose from the rifle chamber, allowing an operator or shooter to then move the bolt handle fully rearwardly along a horizontal receiver loading and ejection slot to eject the cartridge casing.

Still another object of the present invention in a mechanical tight cartridge casing release for a rifle bolt is to provide a bolt having a pivot mounted arm or handle extending therefrom, which bolt may be for use in a rifle that has been bored to receive a conventional cartridge or where the bolt forward extractor end is arranged to fit within a large diameter cartridge casing rim and connects to a slot formed around the cartridge rim inner surface.

The present invention is in a mechanical tight cartridge casing release for a rifle bolt that includes an arm or handle that is pivotally mounted on one end to the side of the rifle bolt to have a forward arm or handle shoulder end that is adjacent to the bolt. A forward portion of the handle shoulder end is to engage and brace against a flat section of a bolt handle receiver horizontal slot, and when urged thereagainst by the arm or handle being pulled rearwardly by an operator or shooter, provides a lever action to break the spent cartridge casing free from the rifle chamber. Arm or handle rearward pivoting is initiated after the bolt handle is lifted upwardly along a receiver vertical slot unlocking the bolt from the rifle chamber. The bolt is then initially pulled rearwardly, the arm or handle pivot end engaging a receiver forward end surface to provide a lever action that provides a mechanical advantage to the force an operator or shooter applies to the handle to break the spent cartridge casing free from the rifle chamber, with the bolt then pulled fully rearwardly to eject the spent cartridge casing from the rifle receiver. To facilitate handle movement the arm or handle end is preferably arranged for gripping by the operator or shooter.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
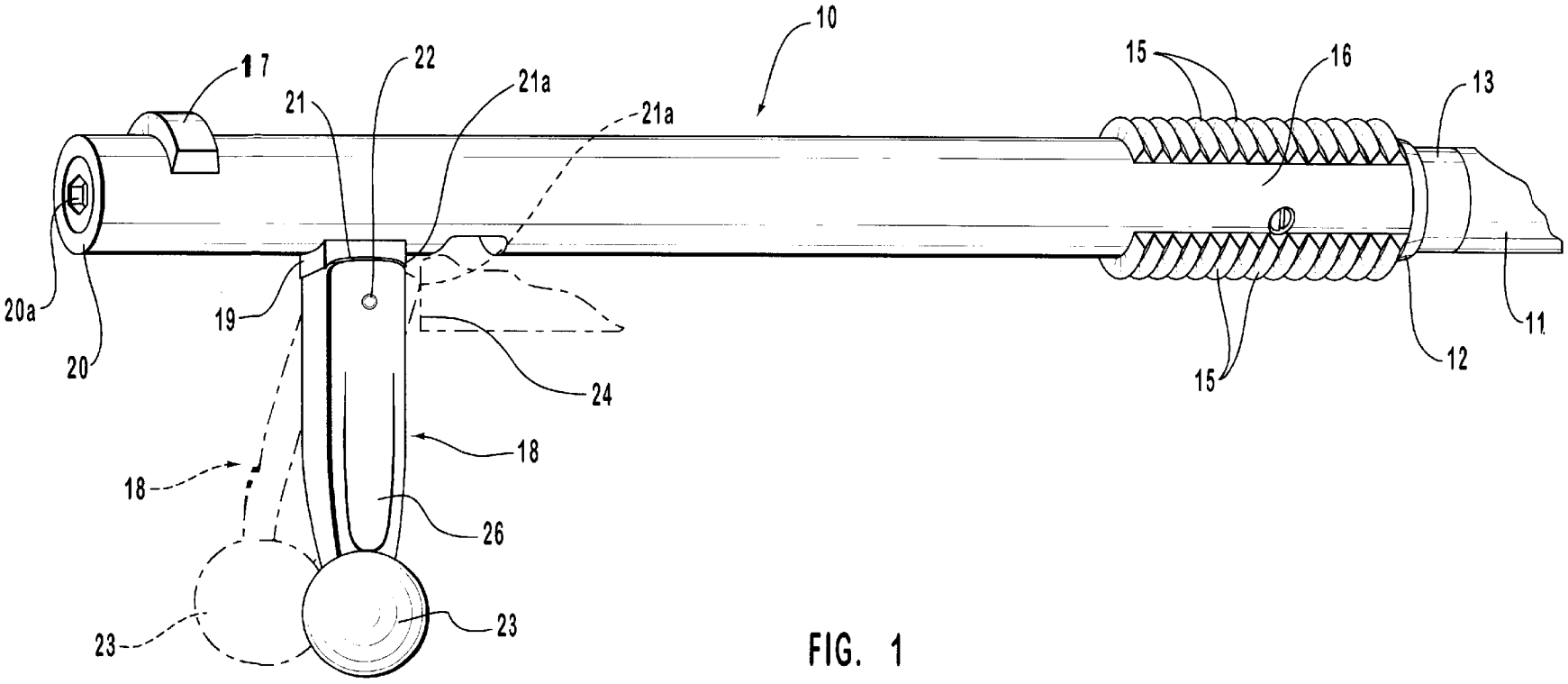
FIG. 1 is a side elevation perspective view of a bolt for a large caliber rifle removed from a rifle receiver and showing a primer end of a wide cartridge casing fitted over the bolt firing pin end, with the bolt shown as including a bolt arm or handle pivotally mounted to extend from a solid section of the bolt side and showing, in broken lines, a section of a vertical receiver slot flat face that is immediately opposite to a forward shoulder of the arm or handle end forward from the pivot, which arm or handle forward shoulder is also shown in broken lines engaging the slot flat face as the handle is pulled rearwardly, as shown also in broken lines.

FIG. 1 is side elevation perspective view of a rifle bolt 10 that includes the invention and is preferably for use in a large chamber rifle, not shown, with the rifle bolt preferably configured to fit into and releasably connect within a primer rim of a cartridge 11 that may be like that shown in the earlier invention of the present inventor identified as a "Cartridge and Method of Manufacturing a Cartridge for a Firearm" set out in U.S. patent application Ser. No. 08/683,078, that is presently pending. Though it should be understood that the rifle bolt 10 of the invention can be arranged for use with any rifle chamber to receive a high powered cartridge, within the scope of this disclosure.

A firing pin extension end 12 of rifle bolt 10 is shown in FIG. 1 seated in a primer end wall 13, where an extractor mechanism that is fitted to the bolt end 12, not shown, has coupled into a groove, not shown, that is formed around the cartridge rim interior wall 13. So arranged, after the cartridge 11 is fired, an operator or shooter pulls the bolt 10 rearwardly to pull a spent cartridge 11 therewith to where a rifle ejector mechanism, not shown, ejects that casing out of the rifle receiver. A section of such a rifle receiver 14 is shown in FIGS. 2 and 3.

The bolt 10, like earlier rifle bolts as are suitable for rifles having large chambers for firing high powered cartridges, preferably a number of thread flights 15 are incorporated along a forward section thereof A longitudinal gap 16 is shown formed between which sections of thread flights 15 that is to pass by like rifle breech sections of thread flights formed adjacent to the rifle chamber, not shown. The combination of such sections of thread flights 15 and the breech thread flights are commonly known as cannon breech threads and are arranged to pass by one another and to interdigitate in meshing engagement when the respective sections of thread flights are turned across one another, locking together, as occurs when the bolt 10 is turned approximately a quarter turn. So arranged, with the bolt 10 fitted into the rifle breech, and the bolt turned downwardly, not shown, the respective section of thread flights 15 and breech section of thread flights will mesh to lock the bolt 10 in the rifle breech in anticipation of the rifle trigger, not shown, being pulled. When the trigger is so operated, a firing pin end, not shown, is extended out of the bolt IO firing pin end 13 to strike a cartridge primer, not shown, firing a bullet out of the rifle.

Adjacent to the rear end of bolt 10 a guide collar section 17 is shown mounted thereon that is to support the bolt surface in the receiver and is on a bolt surface that is opposite to a bolt arm or handle 18 mounting. For which bolt arm or handle 18, a mounting block or pier 19 is secured along the bolt surface spaced forward from a bolt rear end 20, that includes a center longitudinal passage 20*a* which bolt longitudinal passage contains a bolt firing pin, not shown, that is fitted to slide therein and extend a firing pin forward end out of the bolt 10 firing pin end 13 to strike a cartridge primer.

Figure 3:
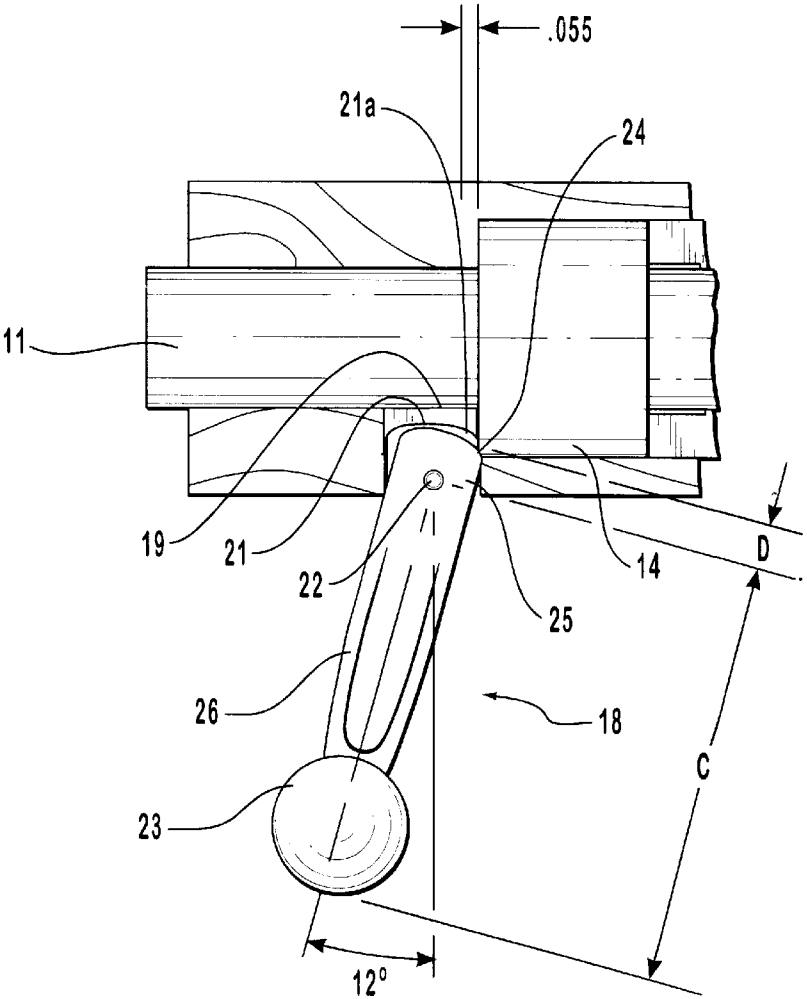
FIG. 3 is a view like that of FIG. 2 only showing the handle as having been moved rearwardly an angle beta ($\beta$) taken across the rifle receiver, pivoting the handle forward shoulder against the receiver flat surface through a distance alpha ($\alpha$).
Figure 2:
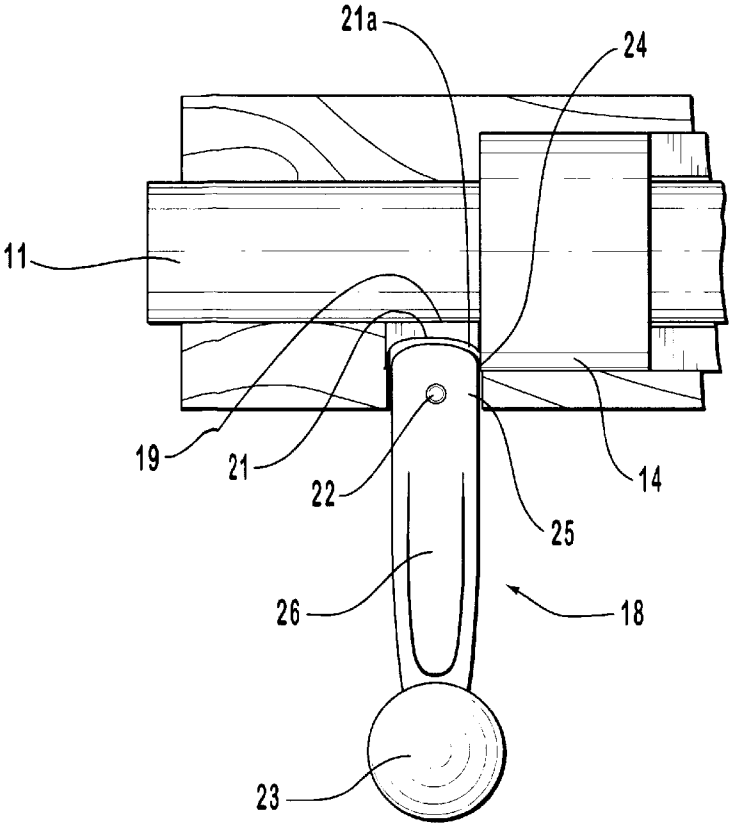
FIG. 2 is a is a top plan view of a section of the bolt at the handle pivot mount showing the bolt section fitted into a portion of the rifle receiver that is maintained in a section of the rifle stock.

Shown in FIGS. 2 and 3, the bolt arm or handle 18 is shown a solid bar 26 that includes a bolt coupling end 21 that is mounted by a pivot 22, shown as a pin, that has been fitted therethrough and through the bolt mounting block 19, with the arm or handle 18 to extend at approximately a right angle outwardly from the bolt side. A ball is shown secured across the handle outer end for convenient gripping by an operator or shooter though other shape or design of arm or handle end could be so incorporated to facilitate gripping by an operator or shooter, within the scope of this disclosure. In operation, the operator or shooter holding a rifle that incorporates bolt 10, unlocks the respective bolt section of thread flights 15 from the breech section of thread flights by lifting the handle 18 along a vertical receiver slot 25, to the attitude shown in FIGS. 2 and 3. This action pivots the bolt to where the handle 18 aligns with a horizontal receiver loading and ejection slot. Thereat, the operator or shooter pulls on the handle ball end 23 to pivot the handle 18 rearwardly around pivot 22 through an angle beta ($\beta$), shown in FIG. 3 that is shown as an angle of approximately twelve (12) degrees but may be an angle from ten (10) to fifteen (15) degrees, dependent upon the arrangement of pivot 22. Handle 18 pivoting is transmitted to a handle forward shoulder 21*a* that is thereby rotated against a flat surface 24 and travels a distance alpha ($\alpha$) that is approximately 0.055 inches, as shown in the Figures. For which handle or arm forward shoulder 21*a* rotation, a force as the operator or shooter applies at handle ball end 23 receives a mechanical advantage of seven (7) to one (1) that is a function of the moment arm distance of the handle ball end 23 from the pivot 22 and the distance from the pivot to the arm or handle forward shoulder 21*a* surface that engages the receiver surface 24. An increased force from that force that the operator or shooter has applied at the handle forward shoulder 21 point of contact to the receiver flat surface 24, "breaks loose" a spent cartridge casing from the rifle chamber. In practice, a distance "C" of the handle ball end 23 from the pivot 22 and a distance "D" from the pivot to the forward shoulder 21*a* from the pivot 22 are selected to provide the seven (7) to one (1) mechanical advantage. Which mechanical advantage can, of course, be altered by an adoption of distance relationships of the handle or arm end distance to pivot 22 and the spacing distance of the pivot to the forward shoulder 21*a*.

After the spent cartridge 11 casing is freed from the rifle breech the operator or shooter continues to pull the handle 18 rearwardly with the bolt 11 traveling along the rifle receiver to where a rifle ejector mechanism, not shown, operates to ejected the spent cartridge casing. Thereafter, the bolt 10 can then be moved forward by handle 18 to pick up a next cartridge 11 and insert it through the rifle breech and into the rifle chamber, with the bolt then turned, as described above, locking the cartridge and bolt end in the rifle chamber in preparation for again firing the rifle.

Hereinabove has been set out a description of a preferred embodiment of the invention in a mechanical tight cartridge casing release for a bolt action rifle and its use to "break loose" a spent cartridge casing from a rifle chamber prior to withdrawing that casing and ejecting it out from the rifle receiver, and while a preferred embodiment has been shown and described herein, it should be understood that the present invention can be varied within the scope of this disclosure without departing from the subject matter coming within the scope of the following claims, and a reasonable equivalency thereof, which claims I regard as my invention.

I claim:

1. A mechanical tight cartridge casing release for a rifle bolt comprising, a rifle bolt for fitting into a rifle receiver to engage and maintain, on a bolt firing pin end, a primer end of a cartridge and to lock said cartridge in a chamber of said rifle, with said rifle bolt including an arm connected by a pivot means to extend outwardly from a side of said bolt, which said arm includes a shoulder that is spaced from said pivot means toward said bolt surface for engaging a surface of said rifle receiver when an outer end of said arm is moved to pivot said arm rearwardly away from a breech of said rifle, and with said pivot means consisting of a fastener that is fitted through said arm adjacent to its end and through a bar that is secured to extend outwardly from the surface of the bolt.

2. A mechanical tight cartridge casing release as recited in claim 1, wherein the arm outer end is formed into a ball.

3. A mechanical tight cartridge casing release as recited in claim 1, wherein the surface of said receiver that is engaged by the arm forward shoulder is flat.

4. A mechanical tight cartridge casing release as recited in claim 3, wherein when the handle is moved rearwardly to approximately a twelve (12) degree angle from a right angle to the bolt to move the arm forward shoulder a distance of approximately 0.055 inches.

5. A mechanical tight cartridge casing release for a rifle bolt comprising a rifle bolt for fitting into a rifle receiver to engage and maintain, on a bolt firing pin end, a primer end of a cartridge and to lock said cartridge in a chamber of said rifle, with said rifle bolt including an arm connected by a pivot means to extend outwardly from a side of said bolt, and with said arm including a shoulder that is spaced from said pivot means toward said bolt surface for engaging a surface of said rifle receiver when an outer end of said arm is moved to pivot said arm rearwardly away from a breech of said rifle and with the distance from said arm outer end to said pivot means and distance of said handle forward shoulder to said pivot means selected to provide approximately a seven (7) to one (1) mechanical advantage.

6. A mechanical tight cartridge casing release as recited in claim 5, wherein the arm outer end is formed into a ball.

7. A mechanical tight cartridge casing release as recited in claim 5, wherein the surface of said receiver that is engaged by the arm forward shoulder is flat.

8. A mechanical tight cartridge casing release as recited in claim 7, wherein when the handle is moved rearwardly to approximately a twelve (12) degree angle from a right angle to the bolt to move the arm forward shoulder a distance of approximately 0.055 inches.

* * * * *